US008884837B2

(12) United States Patent
Chang et al.

(10) Patent No.: US 8,884,837 B2
(45) Date of Patent: Nov. 11, 2014

(54) ANTENNA MODULE AND ELECTRONIC DEVICE WITH THE SAME

(75) Inventors: Chia-Hao Chang, Taipei (TW); Min-Jui Huang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 404 days.

(21) Appl. No.: 13/220,165

(22) Filed: Aug. 29, 2011

(65) Prior Publication Data

US 2012/0050116 A1 Mar. 1, 2012

(30) Foreign Application Priority Data

Aug. 30, 2010 (CN) ..... 2010 1 0266488

(51) Int. Cl.
*H01Q 1/24* (2006.01)
*H01Q 1/10* (2006.01)

(52) U.S. Cl.
CPC ..... *H01Q 1/244* (2013.01)
USPC ..... 343/889; 343/724; 343/906

(58) Field of Classification Search
None
See application file for complete search history.

(56) References Cited

U.S. PATENT DOCUMENTS

| | | | | | |
|---|---|---|---|---|---|
| 4,313,119 | A * | 1/1982 | Garay et al. | 343/702 |
| 4,860,024 | A * | 8/1989 | Egashira | 343/702 |
| 4,958,382 | A * | 9/1990 | Imanishi | 455/277.1 |
| 5,138,329 | A * | 8/1992 | Saarnimo et al. | 343/702 |
| 5,583,519 | A * | 12/1996 | Koike | 343/702 |
| 5,754,141 | A * | 5/1998 | Thompson et al. | 343/702 |
| 5,764,191 | A | 6/1998 | Tsuda | |
| 5,859,617 | A * | 1/1999 | Fujikawa | 343/702 |
| 6,166,697 | A * | 12/2000 | Granqvist et al. | 343/702 |
| 6,380,898 | B1 * | 4/2002 | Moore et al. | 343/702 |
| 6,980,160 | B2 * | 12/2005 | Candal | 343/702 |
| 2004/0160379 | A1 * | 8/2004 | Chen et al. | 343/846 |

FOREIGN PATENT DOCUMENTS

| | | | |
|---|---|---|---|
| CN | 1134610 | A | 10/1996 |
| CN | 1259232 | A | 7/2000 |
| CN | 1780047 | A | 5/2006 |
| CN | 101420467 | A | 4/2009 |

* cited by examiner

*Primary Examiner* — Trinh Dinh
(74) *Attorney, Agent, or Firm* — Muncy, Geissler, Olds & Lowe, P.C.

(57) ABSTRACT

An antenna module includes an antenna body, a signal feeding element and a conducting element. The signal feeding element is mounted on the antenna body, and the antenna body can move between a first position and a second position relative to the signal feeding element. When the antenna body is at the first position, the antenna body contacts and conducts with the conducting element to form a loop. When the antenna body is at the second position, the antenna body does not contact with the conducting element. In an embodiment, antenna receives signal well in both position.

8 Claims, 7 Drawing Sheets

ANTENNA MODULE AND ELECTRONIC DEVICE WITH THE SAME

CROSS REFERENCE TO RELATED APPLICATIONS

This Non-provisional application claims priority under 35 U.S.C. §119(a) on Patent Application No(s). 201010266488.4 filed in People's Republic of China on Aug. 30, 2010, the entire contents of which are hereby incorporated by reference.

BACKGROUND OF THE INVENTION

1. Field of Invention

The invention relates to an antenna module and, more particularly, to an antenna module applied to an electronic device.

2. Related Art

As mobile devices (such as a notebook computer, a mobile phone, or a personal digital assistant) are widely used, more and more additional functions are needed. One of the additional functions is the digital TV. The digital TV becomes more and more mobilized, so as to provide a diversified and convenient life to users. Consequently, the television broadcast digitalization is developed globally. For example, a DTV tuner of a mini plug-and-play device, such as a portable USB dongle, or a handheld TV integrated with a multi-media and global navigation function becomes the best choice for the user to watch TV anytime and anywhere.

A digital TV antenna is preferably implemented to receive digital TV signal. Currently, the digital TV antennas for portable digital TV products, the digital TVs for vehicles or the digital TV tuners in market are elongated monopole bar antennas. Such bar antennas are hardly receiving signal when being hidden in the casing of the digital TV. In other words, when the user watches the digital TV, they have to pull out and extend the bar antenna from the casing of the digital TV to receive signal well. However, the extended bar antenna may be too space occupied, and cause difficulty for carrying.

SUMMARY OF THE INVENTION

An antenna module and an electronic device using a conducting element to connect to a grounding area in a casing of the electronic device is disclosed. When the antenna body is hidden in the casing of the electronic device, the antenna body is connected to the conducting element to form a loop. It is noticed that the conducting element may be freely designed at any one of two sides of the signal feeding element, along a longitudinal path of antenna body of the electronic device, to function as an antenna loop, eg. an inverted-F antenna (IFA).

The antenna module includes an antenna body, a signal feeding element and a conducting element. The signal feeding element is mounted on the antenna body, and the antenna body can move between a first position and a second position relative to the signal feeding element. When the antenna body is at the first position, the antenna body contacts and conducts with the conducting element. When the antenna body is at the second position, the antenna body does not contact with the conducting element.

Moreover, the electronic device includes a circuit board, a grounding area and an antenna module. The antenna module includes an antenna body, a signal feeding element and a conducting element. The signal feeding element is connected to the circuit board and mounted on the antenna body. The antenna body can move between a first position and a second position relative to the signal feeding element. The conducting element is connected to the grounding area. When the antenna body is at the first position, the antenna body contacts and conducts with the conducting element, and when the antenna body is at the second position, the antenna body does not contact with the conducting element.

According to the description above, the first position is the position that allows the antenna body to be hidden in the casing of the electronic device, and the second position is the position that allows the antenna body to be extended from the casing of the electronic device. When the antenna body is hidden in the casing of the electronic device, the antenna body contacts and conducts with the conducting element to form a circuit, such that the antenna body and the conducting element functions as an inverted-F antenna (IFA). When the antenna body is pulled out and extended from the casing of the electronic device, the antenna body does not contact with the conducting element. The antenna body functions as a monopole antenna. Whether the antenna body is extended from the casing of the electronic device or hidden in the casing of the electronic device, the electronic device receives signal effectively, which is convenient for the user.

These and other features, aspects and advantages of the present invention will become better understood with regard to the following description, appended claims, and accompanying drawings.

DETAILED DESCRIPTION OF THE INVENTION

Figure 1:
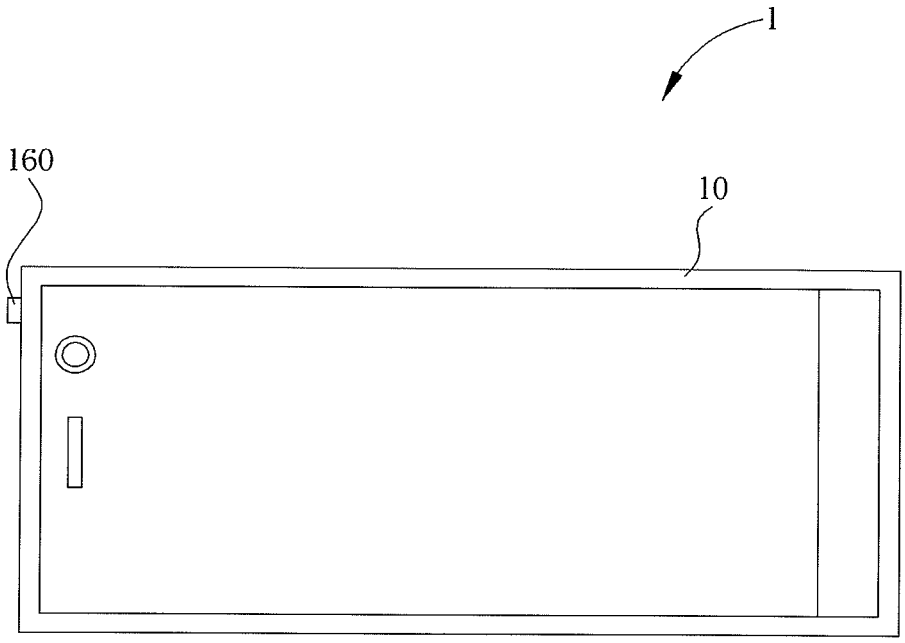
FIG. 1 is a schematic diagram showing an electronic device in a first embodiment of the invention.
Figure 2:
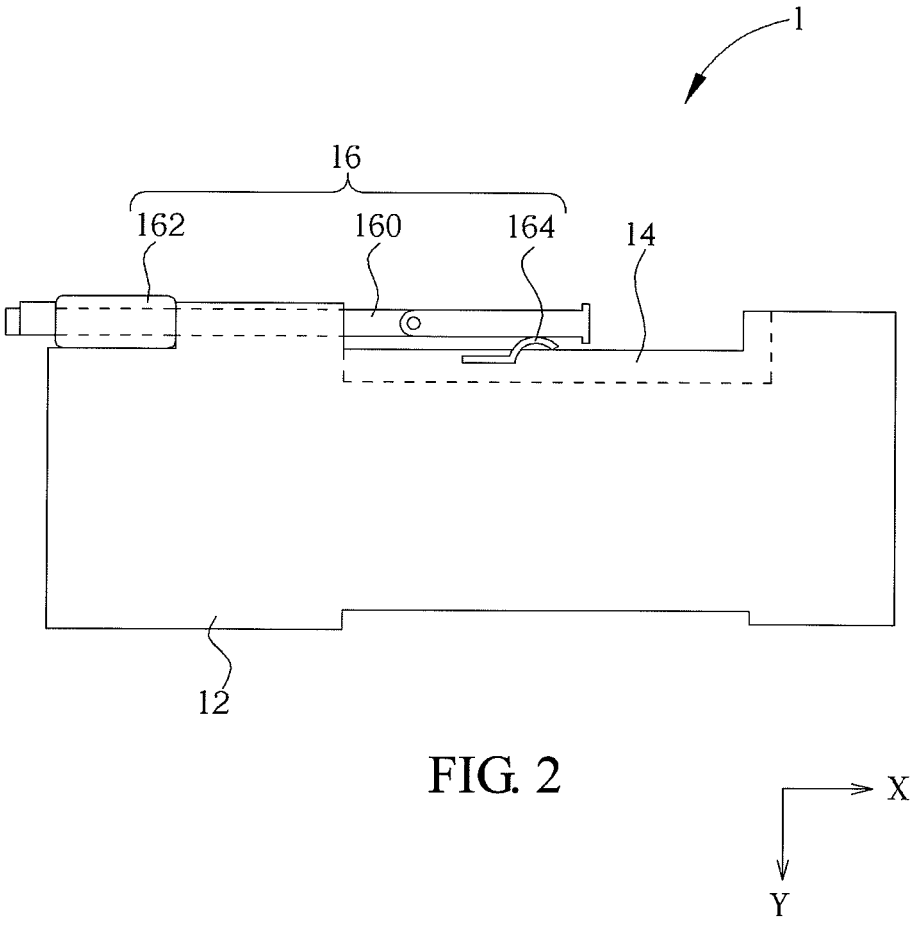
FIG. 2 is a schematic diagram showing inner structure of the electronic device in FIG. 1.
Figure 3:
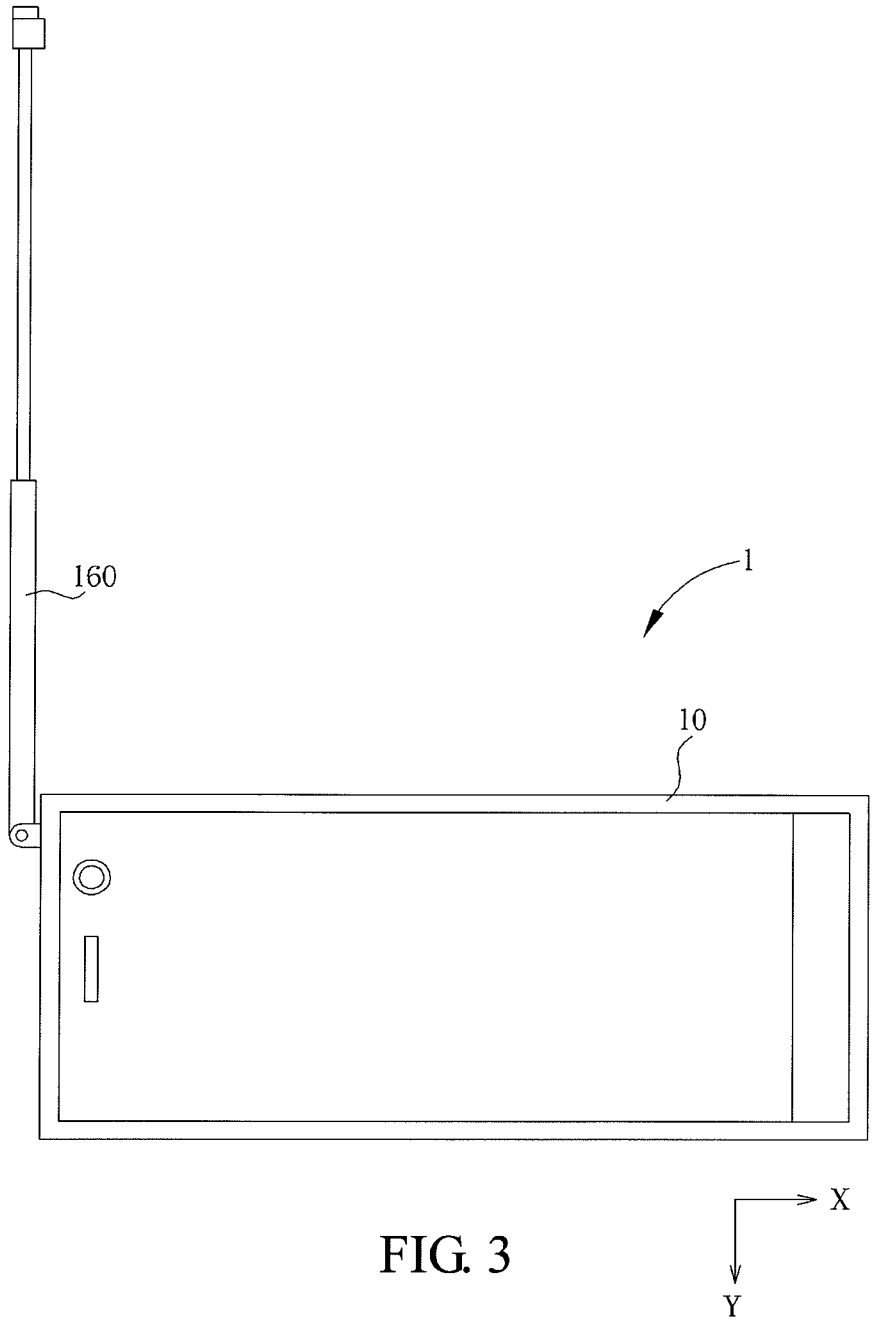
FIG. 3 is a schematic diagram showing that an antenna body in FIG. 1 is extended from a casing.
Figure 4:
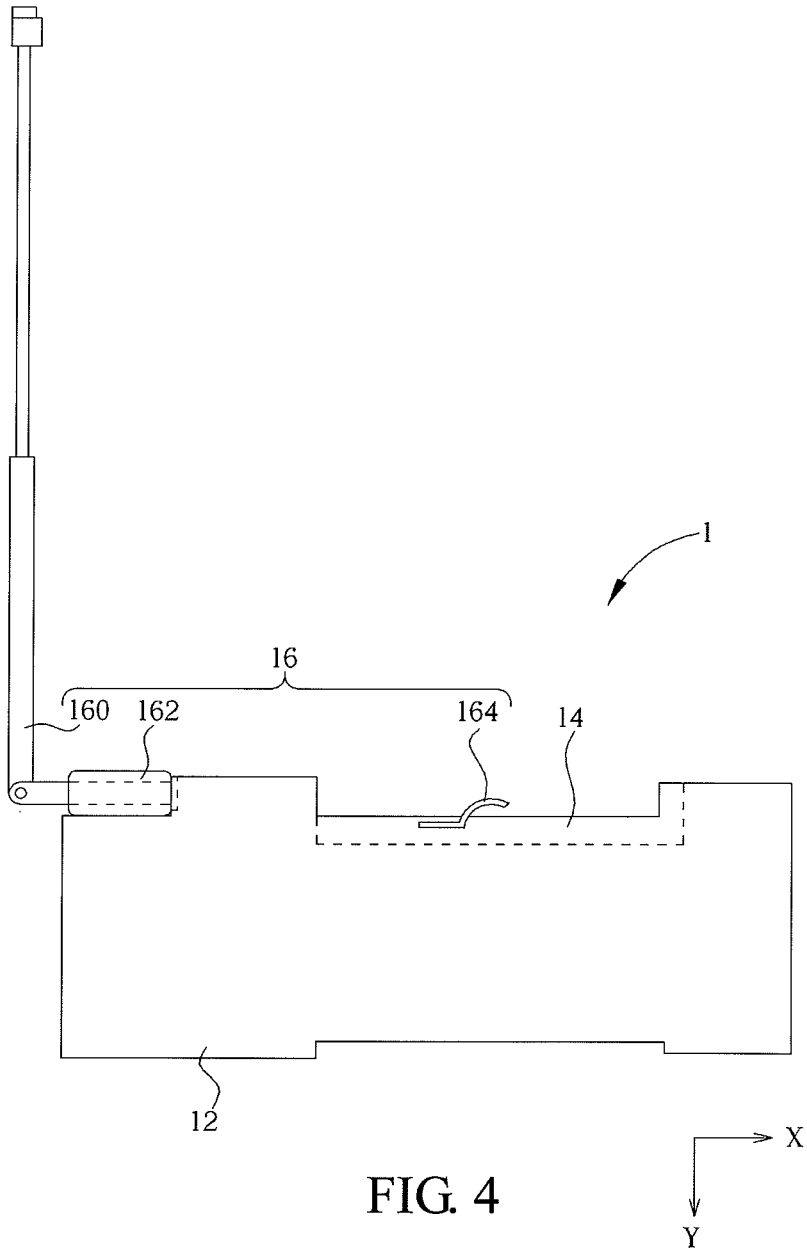
FIG. 4 is a schematic diagram showing inner structure of the electronic device in FIG. 3.

FIG. 1 is a schematic diagram showing an electronic device 1 in a first embodiment of the invention. FIG. 2 is a schematic diagram showing inner structure of the electronic device 1 in FIG. 1. FIG. 3 is a schematic diagram showing that an antenna body 160 in FIG. 1 is extended from a casing 10. FIG. 4 is a schematic diagram showing inner structure of the electronic device 1 in FIG. 3. As shown in FIG. 1 to FIG. 4, an electronic device 1 includes a casing 10, a circuit board 12, a grounding area 14 and an antenna module 16. The electronic device 1 may be a digital TV device or other electronic devices (such as a notebook, a mobile phone or a PDA) with the function of the digital TV. The circuit board 12, the grounding area 14 and the antenna module 16 are all disposed in the casing 10. In the first embodiment, the grounding area 14 may be disposed at the circuit board 12. In another embodiment, the grounding area 14 may also be disposed at any position in the casing 10 according to practical application.

In general, except for the components above, the electronic device 1 may also include other software and hardware such as a central processing unit (CPU), a random access memory (RAM), a Read Only Memory (ROM), a power supply, a backlight module, an operation system (OS), which are necessary for operation according to practical application. The function and structure of those components can be achieved and applied by person having ordinary skill in the art, which is omitted herein.

The antenna module 16 includes an antenna body 160, a signal feeding element 162 and a conducting element 164. In the embodiment, the antenna body 160 may be a bar antenna, which is not limited herein. The signal feeding element 162 is connected to the circuit board 12 and mounted on the antenna body 160. Wireless signal received by the antenna body 160 can feed to the circuit board 12 via the signal feeding element 162. Notably, the fewer metal components nearby the signal feeding element 162, the better signal receiving effect is achieved. The conducting element 164 is connected to the grounding area 14. In the embodiment, the conducting element 164 may be a metal with good electrical conductivity, such as copper, gold, which is not limited herein.

The antenna body 160 can move between a first position (as shown in FIG. 1 and FIG. 2) and a second position (as shown in FIG. 3 and FIG. 4) relative to the signal feeding element 162. In other words, when the user pulls out the antenna body 160 from the casing 10, the antenna body 160 is at the first position shown in FIG. 1 and FIG. 2. When the user hides the antenna body 160 in the casing 10, the antenna body 160 is at the second position shown in FIG. 3 and FIG. 4.

As shown in FIG. 2 and FIG. 4, the conducting element 164 may be a resilient plate, and one end of the conducting element 164 is welded to the grounding area 14. When the user pulls out the antenna body 160 from the casing 10 to make the antenna body 160 at the second position as shown in FIG. 4, the antenna body 160 does not contact with the conducting element 164. At the time, the antenna body 160 functions as a monopole antenna. when the user hides the antenna body 160 to the casing 10 along the direction X to make the antenna body 160 move to the first position as shown in FIG. 2 along an axis, the antenna body 160 presses the conducting element 164 in Y direction to contact and conduct with the conducting element 164. At the time, the conducting element 164 is at one side of the antenna body 160, and the antenna body 160 and the conducting element 164 can be functioned as an IFA. Thus, no matter whether the antenna body 160 is extended from the casing 10 of the electronic device 1 or hidden in the casing 10 of the electronic device 1, the electronic device 1 can receive signal. The conducting element 164 is adjustably connected to a determined part of the grounding area 14 to obtain a determined bandwidth and center frequency.

Additionally, it is noticed that the conducting element 164 may be freely designed at any one of two sides of the signal feeding element 162, along a longitudinal path of antenna body 160 of the electronic device 1, to function as an antennal loop. For example, in FIG. 2, the conducting element 164 may be designed at the side of the signal feeding element 162 that nearest to an edge of the casing 10. Of course, if required, the position of the signal feeding element 162 may correspondingly rearranged as well. Above all, either sides of signal feeding element 162 that the conducting element 164 tend to dispose, the whole circuit structure forms an antenna loop, eg. an inverted-F antenna (IFA).

Figure 5:
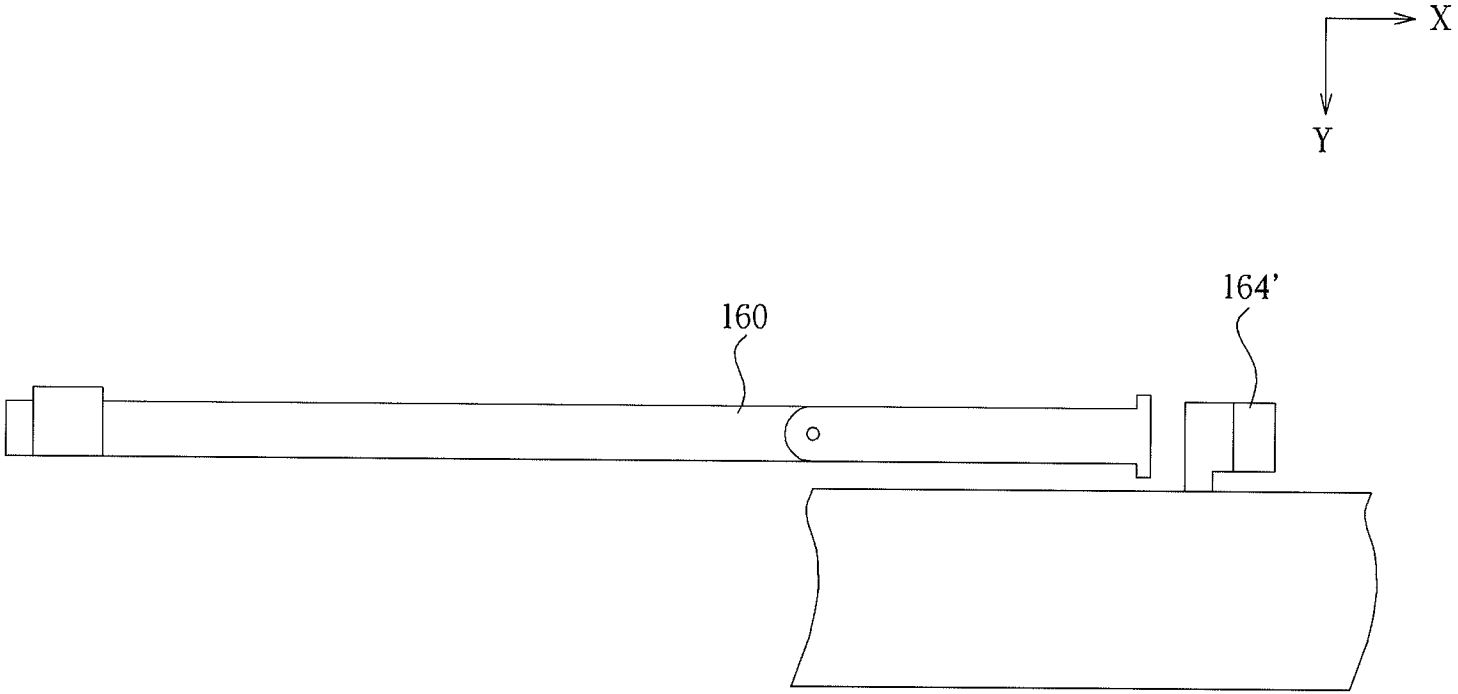
FIG. 5 is a top view showing an antenna body and a conducting element in a second embodiment of the invention.
Figure 6:
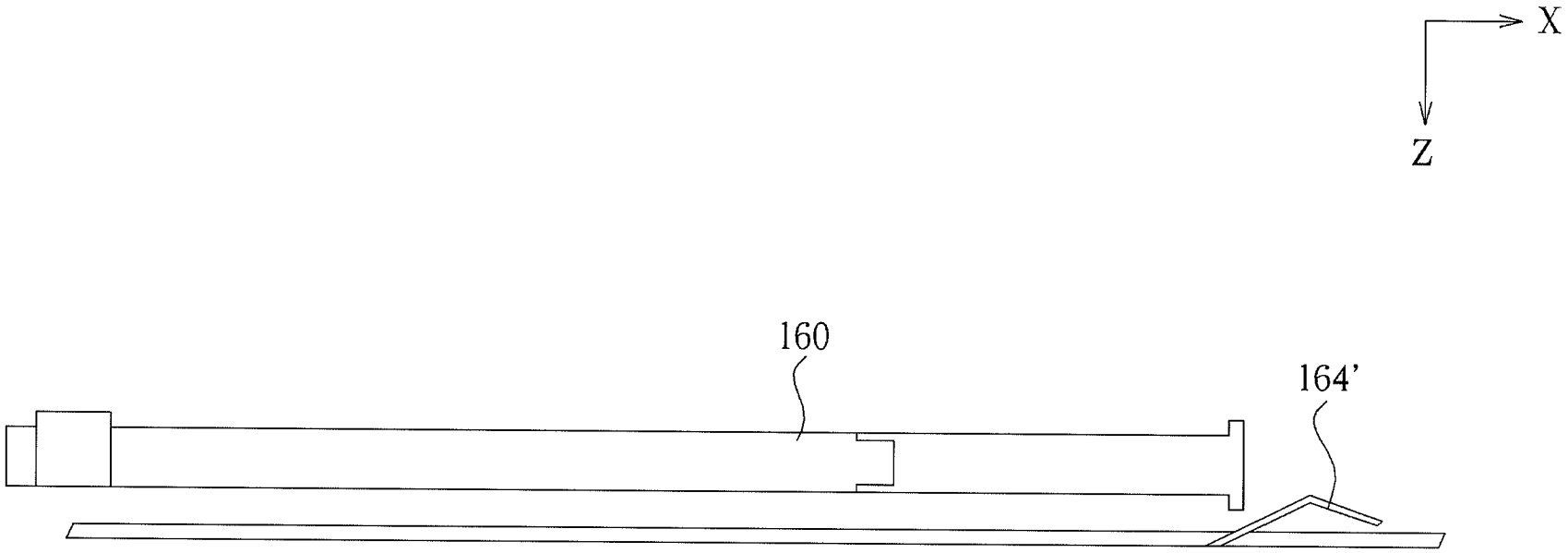
FIG. 6 is a side view showing the antenna body and the conducting element in FIG. 5.

Please refer to FIG. 5 and FIG. 6. FIG. 5 is a top view showing an antenna body 160 and a conducting element 164' in the second embodiment of the invention. FIG. 6 is a side view showing the antenna body 160 and the conducting element 164' in FIG. 5. As shown in FIG. 5 and FIG. 6, the conducting element 164 is also a resilient plate. As shown in FIG. 6, when the antenna body 160 moves towards the direction X along an axis, the antenna body 160 presses the conducting element 164' in direction Z to contact and conduct with the conducting element 164'. At the time, the conducting element 164' is below the antenna body 160.

Figure 7:
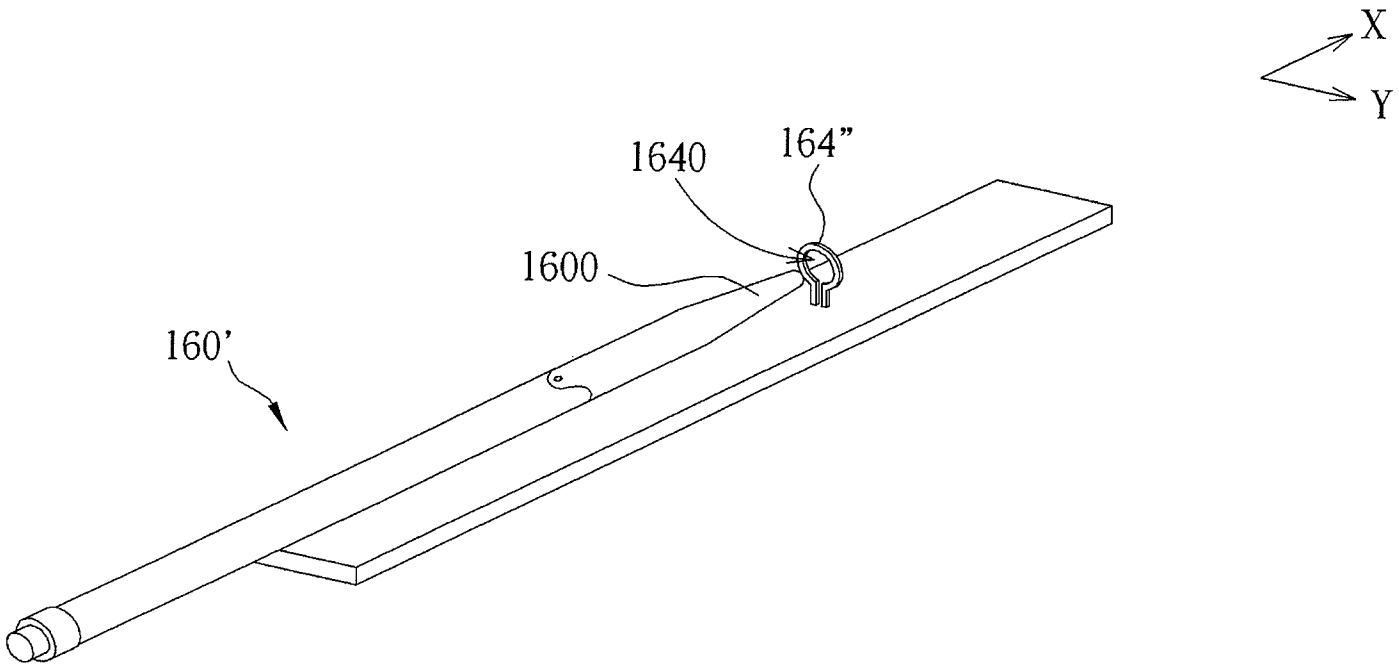
FIG. 7 is a schematic diagram showing an antenna body and a conducting element in a third embodiment.

FIG. 7 is a schematic diagram showing an antenna body 160' and a conducting element 164" in a third embodiment. As shown in FIG. 7, the antenna body 160' includes a tapered end 1600, and the conducting element 164" has a through hole 1640. When the antenna body 160' is at the first position (that is, the antenna body 160' is hidden in the casing 10 of the electronic device 1), the tapered end 1600 engages the through hole 1640 to contact and conduct with the conducting element 164".

Compared with the conventional technology, when the antenna body is hidden in the casing of the electronic device, the antenna body contacts with the conducting element to form a loop. At the time, the antenna body and the conducting element are functioned as an IFA. When the antenna body is extended from the casing of the electronic device, the antenna body does not contact with the conducting element. At the time, the antenna body can be functioned as a monopole antenna. Thus, no matter whether the antenna body is extended from the casing of the electronic device or hidden in the casing of the electronic device, the electronic device can receive signal, which is convenient for the user.

Although the present invention has been described in considerable detail with reference to certain preferred embodiments thereof, the disclosure is not for limiting the scope of the invention. Persons having ordinary skill in the art may make various modifications and changes without departing from the scope. Therefore, the scope of the appended claims should not be limited to the description of the preferred embodiments described above.

What is claimed is:

1. An antenna module, comprising:

an antenna body;

a signal feeding element sleeved on the antenna body, wherein the antenna body is capable of moving between a first position and a second position relative to the signal feeding element; and a conducting element connected to a grounding area;

wherein when the antenna body is at a first position, the antenna body contacts and conducts with the conducting element, and when the antenna body is at a second position, the antenna body does not contact with the conducting element, wherein the antenna body has a tapered end, the conducting element has a through hole, and when the antenna body is at the first position, the tapered end engages the through hole to contact and conduct with the conducting element.

2. The antenna module according to claim 1, wherein the conducting element is a resilient plate, and the antenna body moves to the first position along an axis to press the conducting element to contact and conduct with the conducting element.

3. The antenna module according to claim 1, wherein the antenna body is a bar antenna.

4. An electronic device comprising:

a circuit board;

a grounding area; and an antenna module including:

an antenna body;

a signal feeding element connected to the circuit board and sleeved on the antenna body, wherein the antenna body is capable of moving between a first position and a second position relative to the signal feeding element; and a conducting element connected to the grounding area;

wherein when the antenna body is at a first position, the antenna body contacts and conducts with the conducting element, and when the antenna body is at a second position, the antenna body does not contact with the conducting element, wherein the antenna body has a tapered end, the conducting element has a through hole, and when the antenna body is at the first position, the tapered end engages the through hole to contact with the conducting element.

5. The electronic device according to claim 4, wherein the grounding area is disposed on the circuit board.

6. The electronic device according to claim 4, wherein the conducting element is adjustably connected to a determined part of the grounding area to obtain a determined bandwidth and central frequency.

7. The electronic device according to claim 4, wherein the conducting element is a resilient plate, and the antenna body moves to the first position along an axis to press the conducting element, so as to contact and conduct with the conducting element.

8. The electronic device according to claim 4, wherein the antenna body is a bar antenna.

* * * * *